US006110244A

United States Patent [19]

Wood

[11] Patent Number: 6,110,244

[45] **Date of Patent: *Aug. 29, 2000**

[54] CLEAN AIR SYSTEM

[75] Inventor: Norman Jeffrey Wood, Sutton Benger, United Kingdom

[73] Assignee: Howorth Airtech Limited, Farnworth Bolton, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 09/067,798

[22] Filed: Apr. 28, 1998

Related U.S. Application Data

[63] Continuation of application No. 08/923,832, Sep. 4, 1997, abandoned, which is a continuation of application No. 08/544,817, Oct. 18, 1995, abandoned.

[30] Foreign Application Priority Data

Oct. 22, 1994 [GB] United Kingdom ..... 94 21303

[51] Int. Cl.[7] ..... F24F 13/08

[52] U.S. Cl. ..... 55/385.2; 55/DIG. 29; 454/189; 454/192

[58] Field of Search ..... 55/385.2, 385.7, 55/DIG. 29; 454/187, 189, 190, 192, 193

[56] References Cited

U.S. PATENT DOCUMENTS

| | | | |
|---|---|---|---|
| 3,380,369 | 4/1968 | Allander . | |
| 3,511,162 | 5/1970 | Truhan . | |
| 3,626,837 | 12/1971 | Pelosi, Jr. et al. . | |
| 3,726,203 | 4/1973 | Lindestrom . | |
| 4,427,427 | 1/1984 | DeVecchi | 55/358 |
| 4,883,513 | 11/1989 | Monson et al. | 55/385.2 |
| 5,144,781 | 9/1992 | Fitzner | 52/303 |
| 5,176,569 | 1/1993 | Jardinier et al. | 454/305 |

FOREIGN PATENT DOCUMENTS

| | | |
|---|---|---|
| 0139128 | 5/1985 | European Pat. Off. . |
| 0455567 | 11/1991 | European Pat. Off. . |
| 0535550 | 4/1993 | European Pat. Off. . |
| 2130255 | 1/1972 | Germany . |
| 3410078 | 10/1985 | Germany . |
| 3634703 | 4/1988 | Germany . |
| 61-38614 | 2/1986 | Japan . |
| 61-38615 | 2/1986 | Japan . |
| 61-168736 | 7/1986 | Japan . |
| 63-105346 | 5/1988 | Japan . |
| 2-171533 | 7/1990 | Japan . |
| 1349718 | 4/1974 | United Kingdom . |

OTHER PUBLICATIONS

Ultra Clean Operating Rooms Prevents Airborne Infection, Howorth Airtech, 1996, 4 pages.

*Primary Examiner*—C. Scott Bushey
*Attorney, Agent, or Firm*—Christie, Parker & Hale, LLP

[57] ABSTRACT

A clean air system a fan and a filter assembly for producing a flow of clean air and for discharging the clean air from an outlet towards a clean area. A Coanda effect device is located adjacent to the filter assembly about the whole or part of its periphery, and induces movement of air away from the flow of clean air. Any potentially contaminated air must thus overcome the outward flow of air in order to reach the clean area, thereby reducing the likelihood of contamination of the clean area.

15 Claims, 4 Drawing Sheets

FIG. 3
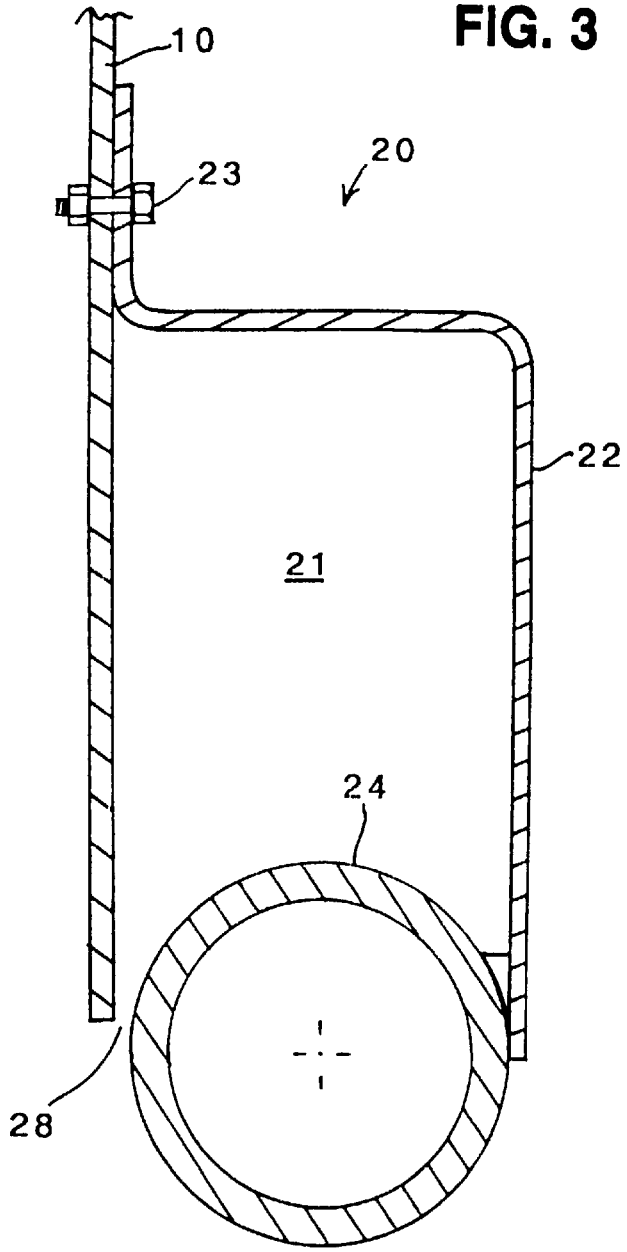
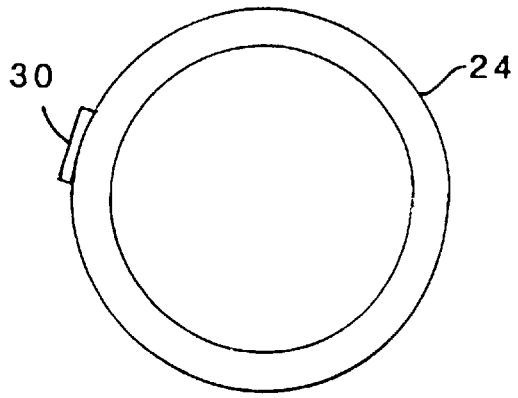
FIG. 4

CLEAN AIR SYSTEM

CROSS REFERENCE TO RELATED APPLICATIONS

This application is a continuation of application Ser. No. 08/923,832, filed Sep. 4, 1997, now abandoned; which is a continuation of application Ser. No. 08/544,817, filed Oct. 18, 1995, abandoned; which claims priority benefits under 35 U.S.C. §119 of British Application No. 9421303.0, filed on Oct. 22, 1994.

BACKGROUND OF THE INVENTION

The present invention relates to clean air systems and in particular, but not exclusively, to clean air systems for use in operating theatres, pharmaceutical product manufacture, semiconductor manufacture and the like.

In known clean air systems air is passed through a filter and directed towards an area to be kept free from contamination (a "clean area").

In known clean air systems it is necessary to ensure that contaminated air does not become mixed with the filtered air in the clean area. This can be achieved by, for example, discharging the filtered air with a differential velocity profile. In our "EXFLOW" system this is achieved by discharging filtered air with a higher velocity at the centre than at the periphery in order to form a generally outward flow of air out of the clean area, making it more difficult for contaminated air to enter the clean area.

SUMMARY OF THE INVENTION

It is an object of the present invention to provide a clean air system which prevents or reduces the possibility of contamination of a clean area by unfiltered air but which does not require the filtered air to be discharged at different velocities.

It is a further object of the present invention to enlarge the size of the clean area.

In accordance with the present invention, a clean air system comprises clean air means for producing a flow of clean air and for discharging the clean air from an outlet towards a clean area and a Coanda effect device, located adjacent to the clean air means, for inducing movement of air away from the flow of clean air.

A "Coanda effect" arises when a tangential jet of air moves past a convex surface. The jet of air exhibits strong attachment to the surface and is deflected from the tangential direction to follow the profile of the curved surface. By utilizing a Coanda effect device in conjunction with a clean air system, the deflected jet of air entrains a portion of the adjacent clean air and produces an outwardly-directed flow of air away from the clean area which may be controlled and directed. Any potentially contaminating air must thus overcome the outward flow of air in order to reach the clean area, and the likelihood of contamination of the clean area by unfiltered air can thus be significantly reduced or even removed. If the tangential jet of air produced by the Coanda effect device is also clean air then the effect is to enlarge the clean area.

Preferably, at least part of the periphery of the outlet is provided with a Coanda effect device. In one embodiment, substantially the whole of the periphery of the outlet is provided with a Coanda effect device.

In one embodiment, a peripheral wall extends downwardly form the periphery of the outlet and the Coanda effect device is located at the lower edge of the peripheral wall.

The Coanda effect device may comprise a plenum chamber which is attached to the exterior of the clean air means and which houses a profiled convex surface spaced apart from the exterior of the clean air means by a gap through which a jet of air is blown by application of air pressure to the plenum chamber. If a peripheral wall extends downwardly from the periphery of the outlet the plenum chamber is connected to the wall and the gap is defined between the profiled convex surface and the wall. The profiled convex surface preferably extends below the level of the outlet (or the lowest level of the wall, if present) and may conveniently take the form of a tube or pipe secured in the plenum chamber.

BRIEF DESCRIPTION OF THE DRAWINGS

By way of example only, specific embodiments of the present invention will now be described, with reference to the accompanying drawings, in which:

FIG. 3 is an enlarged cross-sectional side view of a peripheral portion of the clean air system of FIG. 1;

FIG. 4 is a cross-sectional view of a tube forming one of the components shown in FIG. 3;

DESCRIPTION OF THE PREFERRED EMBODIMENTS

Figure 1:
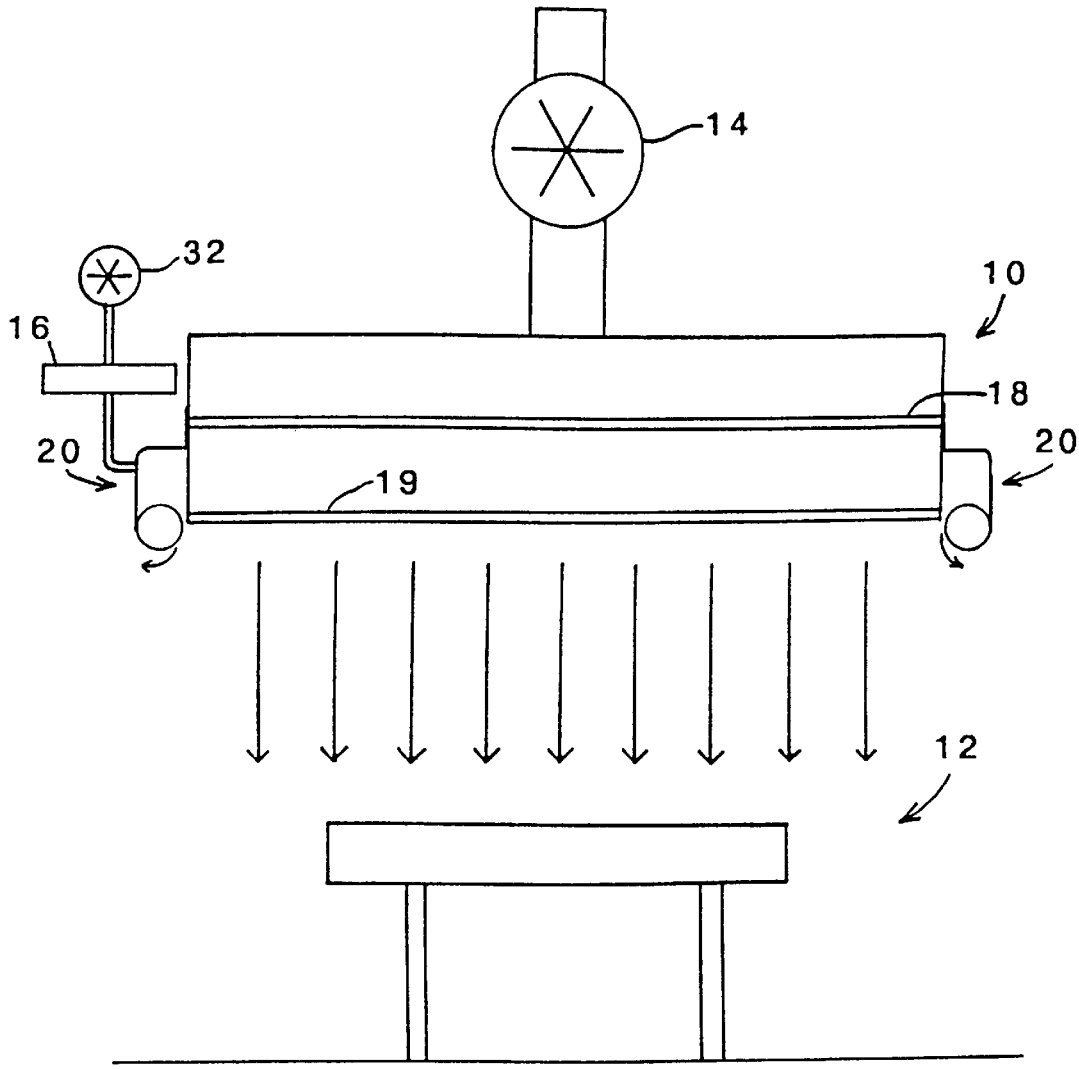
FIG. 1 is a cross-sectional side view of a first embodiment of clean air system in accordance with the present invention.
Figure 2:
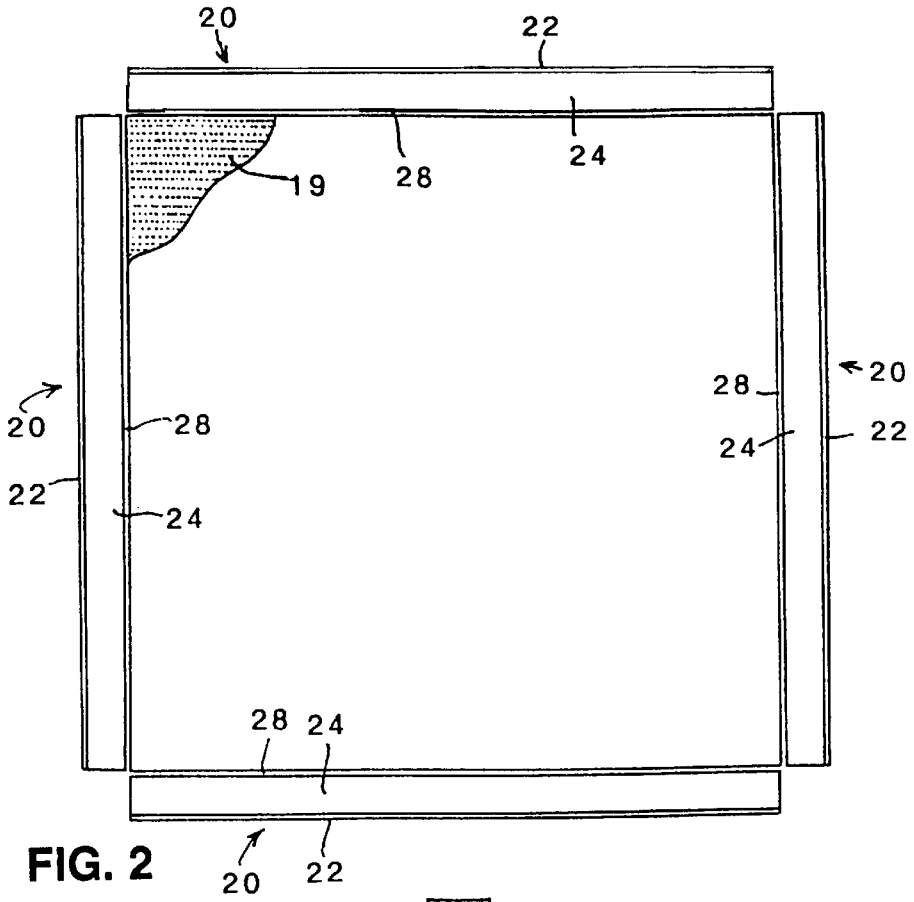
FIG. 2 is an inverted plan view of the clean air system of FIG. 1.

Referring firstly to FIGS. 1 to 4, a first embodiment of clean air system comprises a generally rectangular housing 10 which is secured to a ceiling and which corresponds approximately in shape and size to a clean area 12 below. In this particular embodiment the housing 10 is supplied with air by means of a fan 14 which passes air through a filter assembly 18. However, any arrangement for producing an output of clean air may be used. The clean air is discharged through a rectangular outlet in the form of a perforated screen 19 (part of which is shown in FIG. 2) in the form of a generally downwardly-directed current of air.

Arranged along the lower edge of each side of the housing 10 is a Coanda effect device 20. As best seen in FIG. 3, each Coanda effect device 20 comprises an elongate plenum chamber 21 formed by a shaped, generally rectangular plenum housing 22 which is secured to the housing 10 by bolts 23 or any other suitable fixing means. The plenum housing is open downwardly and the plenum opening receives a Coanda surface member which is conveniently in the form of a tube 24 of 100 mm diameter which is secured in an air-tight manner to the inner face of the plenum housing 22, e.g. by means of fasteners (not shown).

In this embodiment, the tube 24 is arranged such that its longitudinal axis is located below the lower edge of the housing 10 by approximately 12 mm, but this distance can be adjusted to suit the particular circumstances. The tube 24 is also spaced from the housing by a distance of approximately 1.25 mm to produce a longitudinal gap 28 along each edge of the housing 10. The gap 28 is maintained at a preset spacing by mean of shims 30 (see FIG. 4) 1.25 mm thick and 5 mm wide secured to the surface of the tube 24 every 100 mm. Each plenum is also supplied with pressurised air from a blower 32 via a filter 16. In the drawings, only one blower is shown. In practice, each Coanda effect device 20 may have its own blower 32 or a single blower 32 may supply all of the Coanda effect devices 20. Alternatively the fan 14 may replace the blower or blowers 32 and supply air to the Coanda effect devices via the filter 16. There is no requirement for the Coanda effect devices to be supplied with filtered air, but if they are, the size of the clean area is increased.

In use, the fan 14 is switched on, which provides a generally downward flow of filtered air having a substantially uniform velocity profile, resulting in a clean area 12. If present, the blower or blowers 32 is/are also switched on. The construction of the Coanda effect devices 20 results in a tangential jet of air moving past the curved convex surface of each tube 24. The jet is strongly attached to the surface of the tube 24 and follows its profile for a considerable extent, by means of the Coanda effect. This induces suction at the surface of the tube 24 and also entrains upstream surrounding air. Thus, at the periphery of the clean air system the Coanda effect devices produce an outward flow of air, including some of the clean air discharged from the outlet 19 of the housing.

Thus, at the periphery of the clean air system there is a significant outward flow of air resulting from the Coanda effect devices 20 which can significantly reduce, or even eliminate, the contamination of the clean air with exterior, unfiltered air, since the outward flow of air produces an outwardly directed current which any exterior air must overcome in order to enter the clean area.

In addition by controlling and directing the tangential jet the outward flow of air from the clean air system is also controlled and directed and has the effect of enlarging the clean area.

Figure 5:
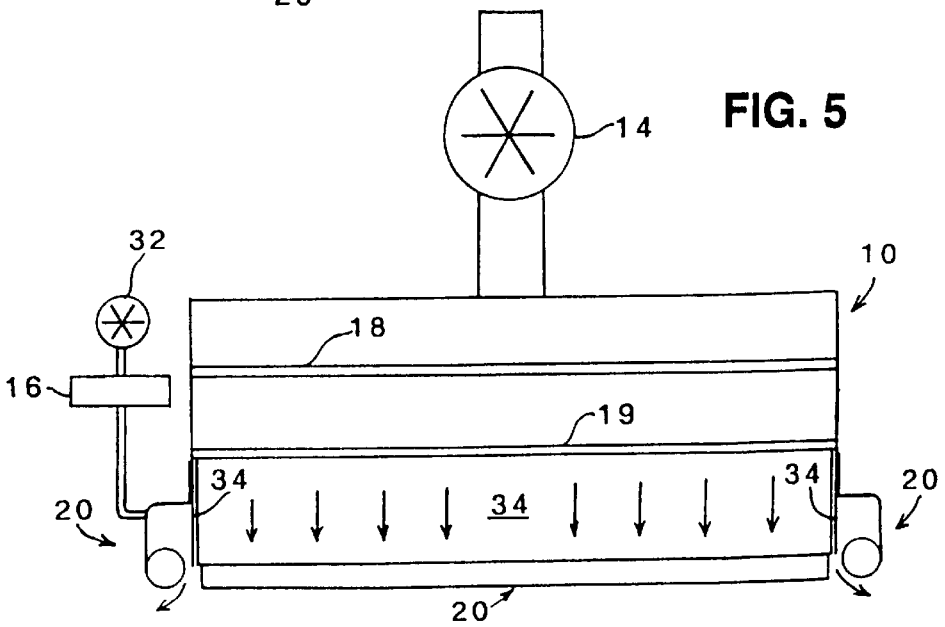
FIG. 5 is a cross-sectional side view of a second embodiment of clean air system in accordance with the present invention.

FIG. 5 shows a second embodiment which is a modification of the first embodiment. The housing 10 is identical to that of the first embodiment but is additionally provided with a downwardly projecting planar wall 34 along each side. Thus, the Coanda effect devices 20 are secured to the outer face of the walls 34 instead of to the housing adjacent to the outlet 19. The provision of the downwardly-projecting walls, which preferably terminate at about head height (e.g. 2.00 m) reduces the likelihood of contamination by unclean air and enables the Coanda effect to take place lower down.

Figure 6:
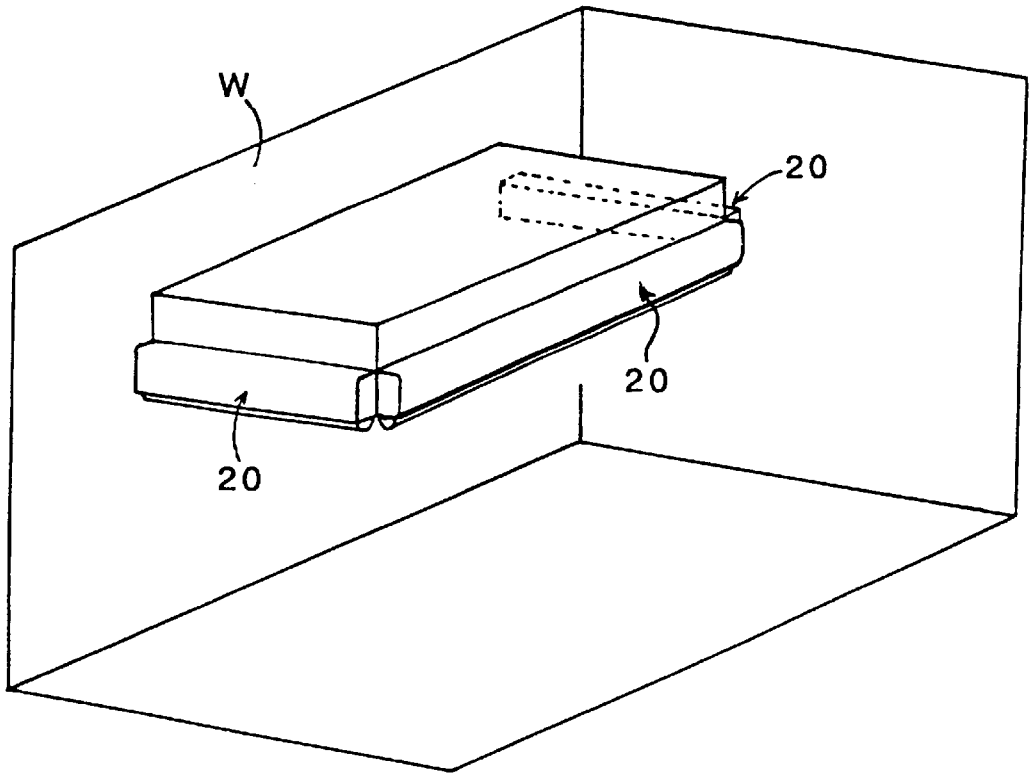
FIG. 6 is a perspective view of a third embodiment of clean air system in accordance with the present invention.

The embodiment of FIG. 6 is very similar to the embodiment of FIG. 1 except that one side of the housing 10 abuts a wall W. Thus, Coanda effect devices 20 are only provided on the remaining three sides since no outward flow of air is possible along the fourth side because of the presence of the wall W. This embodiment could also incorporate the modifications of the second embodiment, namely the downwardly-projecting walls 34.

The invention is not restricted to the details of the foregoing embodiments. For example, the apparatus for producing clean, filtered air need not be the same as that described, but can be any arrangement which produces a flow of clean, filtered air. Moreover, although in the embodiments described the velocity of the discharged clean air is substantially constant it is possible, if desired, to use a differential velocity profile (e.g. as in our "EXFLOW" system) in combination with the Coanda effect devices as described.

Also, the curved surface need not be formed by a tube 24 since only a portion of the surface of the tube is responsible for the Coanda effect. Thus, the tube 24 may be replaced with a profiled section which minimises the amount of material required.

What is claimed is:

1. A clean air system for producing a clean air space within a boundary between the clean air space and a surrounding contaminated air space, the system comprising:

(a) a clean air means for producing a flow of clean air;

(b) an outlet through which said clean air is discharged to a clean area forming a clean air space, the outlet having a periphery defining the boundary between the clean air space and the surrounding air space; and (c) a Coanda effect device, located adjacent the clean air means substantially along the entire said boundary, for inducing movement of air away from the flow of clean air past the Coanda effect device to such contaminated air space, wherein the Coanda effect device comprises a plenum chamber attached to the exterior of said clean air means and which houses a profiled convex surface spaced apart from the exterior of said clean air means by a gap through which a jet of air is blown by application of air pressure to said plenum chamber.

2. A clean air system as claimed in claim 1, wherein the boundary between the clean air space and the contaminated air space is defined around the entire clean air outlet.

3. A clean air system as claimed in claim 1, comprising a peripheral wall extending downwardly from a portion of the periphery of said outlet, said plenum chamber being connected to said wall and said gap being defined between the profiled convex surface and the wall.

4. A clean air system as recited in claim 1, wherein said profiled surface extends below the level of said outlet.

5. A clean air system as claimed in claim 1, wherein said convex surface comprises a tube secured in the plenum chamber.

6. A clean air system as claimed in claim 1, wherein a common source of pressurised air is discharged from said outlet towards the clean air and from said Coanda effect device.

7. A clean air system as claimed in claim 1, comprising a first source of pressurised air to be discharged from said outlet and a second source of pressurised air to be discharged from said Coanda effect device.

8. A clean air system as claimed in claim 1, wherein said Coanda effect device produces an outwardly directed jet of air which entrains a portion of the clean air discharged through the outlet.

9. A clean air system as claimed in claim 1, wherein the size and shape of the outlet correspond generally to the size and shape of the clean area.

10. A clean air system comprising:

clean air means for producing a flow of clean air;

an outlet having a periphery through which said clean air is discharged to a clean area;

an elongate plenum external and adjacent to the outlet, said plenum having a width and receiving air from an air source; and (c) a Coanda effect device external to the outlet for receiving air from the plenum and for inducing movement of air away from the flow of clean air past the Coanda effect device, wherein an elongate gap is formed between the Coanda effect device and the outlet said gap having a width narrower than the width of the plenum.

11. A clean air system as recited in claim 10 wherein the plenum and clean air means receive air from the same air source.

12. A clean air system as recited in claim 10 wherein the plenum receives air from a source different than a source supplying air to the clean air means.

13. A clean air system for producing a clean air space within a boundary between the clean air space and a surrounding contaminated air space, the system comprising:

(a) a clean air means for producing a flow of clean air;

(b) an outlet through which said clean air is discharged to a clean area forming a clean air space, the outlet having a periphery defining the boundary between the clean air space and the surrounding air space;

(c) a peripheral wall extending from the periphery of said outlet; and (d) a Coanda effect device comprising a convex surface within a plenum formed external to the peripheral wall, said Coanda effect device located substantially along the entire said boundary for inducing movement of air away from the flow of clean air past the Coanda effect device to such contaminated air space, wherein an elongate gap is defined between said convex surface and said peripheral wall.

14. A clean air system for producing a clean air space within a boundary between the clean air space and a surrounding contaminated air space, the system comprising:

(a) a clean air means for producing a flow of clean air;

(b) an outlet through which said clean air is discharged to a clean area forming a clean air space, the outlet having a wall and a periphery, wherein said clean air space is formed within the periphery;

(c) a peripheral wall external to and spaced apart from said outlet wall forming a plenum with the outlet wall; and (d) a Coanda effect device located between the outlet wall and the plenum wall forming a gap between the outlet wall and said Coanda effect device, said Coanda effect device being located substantially along the entire said outlet wall for inducing a movement of air away from the flow of clean air past the Coanda effect device to such contaminated air space external of the periphery.

15. A clean air system as recited in claim 14 wherein the clean air means is supplied with air from a first source, and wherein the plenum is supplied with air from a second source.

* * * * *